United States Patent [19]

Maag et al.

[11] Patent Number: 4,960,244

[45] Date of Patent: Oct. 2, 1990

[54] ATOMIZING NOZZLE ASSEMBLY

[75] Inventors: Gustav A. Maag, Miami Beach; John N. Wells, Cooper City, both of Fla.

[73] Assignee: Schering Corporation, Kenilworth, N.J.

[21] Appl. No.: 348,743

[22] Filed: May 8, 1989

[51] Int. Cl.[5] ..... B05B 7/06

[52] U.S. Cl. ..... 239/424; 239/550; 118/303

[58] Field of Search ..... 239/423, 424, 566, 550, 239/551, 590, 553; 118/303

[56] References Cited

U.S. PATENT DOCUMENTS

| | | | |
|---|---|---|---|
| 3,128,994 | 4/1964 | Hungate | 239/424 |
| 3,253,944 | 5/1966 | Wurster | 118/303 |
| 3,896,996 | 7/1975 | Roest et al. | 239/424 |
| 4,548,358 | 10/1985 | Fischer | 239/424 |
| 4,783,008 | 11/1988 | Ikeuchi et al. | 239/424 |

*Primary Examiner*—Andres Kashnikow
*Assistant Examiner*—Karen B. Merritt
*Attorney, Agent, or Firm*—Anita W. Magatti; James R. Nelson; Stephen I. Miller

[57] ABSTRACT

An atomizing nozzle for use in a fluidized coating bed includes an elongated hollow tube defining a chamber therein, the tube including an atomizing end in fluid communication with the chamber and a supply end; an air supply port at the supply end in fluid communication with the chamber; a coating liquid supply port at the supply end, the coating liquid supply port being separated from the air supply port; and a flow control tube extending within the hollow tube between the liquid supply port and the atomizing end, for supplying the coating liquid to be atomized to the atomizing end, the flow control tube having an reduced diameter inner bore providing a controlled flow constriction to the liquid travelling from the liquid supply port to the atomizing end so as to supply the coating liquid from the coating liquid supply port to the atomizing end with a controlled flow constriction, such that there is no need to provide a metering pump or flow meter for each atomizing nozzle of the fluidized coating bed and control of the flow through each atomizing nozzle is readily accomplished by varying the internal bore size of the flow control tubes.

21 Claims, 3 Drawing Sheets

EXHAUST FAN

PRIOR ART

ATOMIZING NOZZLE ASSEMBLY

BACKGROUND OF THE INVENTION

This invention relates generally to atomizing nozzles, and more particularly, is directed to a coating assembly including a plurality of atomizing nozzles.

In the pharmaceutical industry, the use of fluidized bed coaters for coating pharmaceutical materials is well known. For example, it is well known to coat potassium chloride crystals with a polymer in the manufacture of a drug sold under the trademark "K-DUR" by Schering-Plough Corporatoin of Madison, N.J. The coated potassium choride crystals are then formed into tablet form. In such case, the coating ensures that the tablet will dissolve slowly in the stomach and intestines of a user, generally in six to eight hours. It is also known, for example, to coat various drugs, such as the asthma drug sold under the trademark "THEO-DUR" with such a polymer coating.

In this regard, in known fluidized bed coaters, the particles to be coated are suspended in an apparatus that creates a strong upward air current or stream in which the particles move. The stream intersects a zone of finely atomized coating liquid which causes the particles to be coated. Thereafter, the coated particles are dried. The foregoing method and appartus are known, for example, from U.S. Pat. Nos. 3,089,824; 3,117,027; 3,196,827; 3,241,520; and 3,253,944, the entire disclosures of which are incorporated herein by reference.

In addition, such an apparatus is sold by Glatt Air Technique, Inc. of Ramsey, N.J. under Model Number GPCG 300/WURSTER 46". In this particular Glatt apparatus, there are seven atomizing nozzles extending into the coating chamber. Each atomizing nozzle is formed by an elongated hollow air tube, along with a coating supply tube extending through the air tube. The coating liquid is supplied to the atomizing end of the nozzle through the coating supply tube, while the air for atomizing the coating liquid is supplied to the atomizing end of the nozzle through an annular gap formed between the coating supply tube and the air tube. As a result of such air and liquid flow, at the outlets of the air tube and coating supply tube, the air tears the liquid stream into tiny droplets. Accordingly, the coating solution is formed into fine droplets.

However, with such apparatus, the inner diameter of each coating supply tube is substantially equal to the inner diameter of the coating liquid supply line connected therewith. As a result, there is no pressure drop in the coating supply tube, and therefore, no regulation of the flow of coating liquid in the coating supply tube. Therefore, to ensure that the liquid coating solution supplied to the atomizing end of each atomizing nozzle is the same, each atomizing nozzle is provided with its own metering device in the form of a metering pump or a flow meter. Thus, for example, with the Glatt fluidized bed coater, seven metering pumps or flow meters must be provided, one for each atomizing nozzle. Such equipment, however, is costly and requires maintenance and recalibration.

Further, with such known atomizing nozzles, there is a problem of assuring positive separation of the liquid stream from the atomizing air stream inside the nozzle body without the use of O-rings or other sealing devices. This is essential since even a small seepage of air into the liquid stream will cause a malfunction of the atomizing nozzle. For example, the Glatt atomizing nozzles are provided with O-rings which must be taken out to clean the nozzles, and which provide a problem of air mixing with the liquid.

OBJECTS AND SUMMARY OF THE INVENTION

Accordingly, it is an object of the present invention to provide an atomizing nozzle that overcomes the aforementioned problems with the prior art.

It is another object of the present invention to provide an atomizing nozzle which includes means for providing controlled flow regulation of the coating liquid supplied to the atomizing end of the nozzle.

It is still another object of the present invention to provide an atomizing nozzle which includes a flow control tube within the air tube of the nozzle such that the flow control tube supplies the coating liquid from a liquid supply port to the atomizing end of the nozzle with a controlled flow constriction.

It is yet another object of the present invention to provide an atomizing nozzle that is essentially maintenance free.

It is a further object of the present invention to provide an atomizing nozzle that assures positive separation of the liquid stream from the atomizing air stream inside the nozzle body without the use of O-rings or other sealing devices.

It is still a further object of the present invention to provide an atomizing nozzle assembly including a plurality of such atomizing nozzles, each supplied with the coating liquid from a common coating liquid source and with the inner bore and the length of the flow control tube of each nozzle being selected to provide a controlled flow rate.

It is yet a further object of the present invention to provide a coating assembly including a chamber for coating a material and a plurlaity of such atomizing nozzles in the chamber, with each nozzle being fed from a common coating liquid source.

In accordance with an aspect of the present invention, an atomizing nozzle includes an elongated hollow tube defining a chamber therein, the tube including an atomizing end in fluid communication with the chamber and a supply end; and air supply port at the supply end in fluid communication with the chamber; a liquid supply port at the supply end, the liquid supply port being separated from the air supply port; and flow constriction means for supplying the liquid from the liquid supply port to the atomizing end with a controlled flow constriction.

In accordance with another aspect of the present invention, an atomizing nozzle assembly includes (a) a plurality of atomizing nozzles, each atomizing nozzle having an elongated hollow tube defining a chamber therein, the tube including an atomizing end in fluid communication with the chamber and a supply end; an air supply port at the supply end in fluid communication with the chamber; a liquid supply port at the supply end, the liquid supply port being separated from the air supply port; and flow constriction means for supplying the liquid from the liquid supply port to the atomizing end with a controlled flow constriction; (b) air supply line means connected with each air supply port for supplying air to the chamber of each of the atomizing nozzles from a common source of air; and (c) liquid supply line means connected with each liquid supply port for supplying the liquid to the flow constriction means of each of the atomizing nozzles from a common source of the liquid.

In accordance with still another aspect of the present invention, a coating assembly includes (a) a housing; (b) screen means in the housing for supporting a material to be coated; (c) a plurality of atomizing nozzles positioned to coat the material with a coating liquid, each atomizing nozzle having an elongated hollow tube defining a chamber therein, the tube including an atomizing end in fluid communication with the chamber and a supply end, an air supply port at the supply end in fluid communication with the chamber, a coating liquid supply port at the supply end, the coating liquid supply port being separated from the air supply port, and flow constriction means for supplying the coating liquid from the coating liquid supply port to the atomizing end with a controlled flow constriction; (d) air supply line means connected with each air supply port for supplying air to the chamber of each of the atomizing nozzles from a common source of air; (e) coating liquid supply line means connected with each coating liquid supply port for supplying the coating liquid to the flow constriction means of each of the atomizing nozzles; and (f) single metering control means for controlling the flow of coating liquid from a coating liquid source to the coating liquid supply line means.

The above and other objects, features and advantages of the present invention will become readily apparent from the following detailed description which is to be read in connection with the accompanying drawings.

DETAILED DESCRIPTION OF THE PREFERRED EMBODIMENTS

Figures 1, 2:
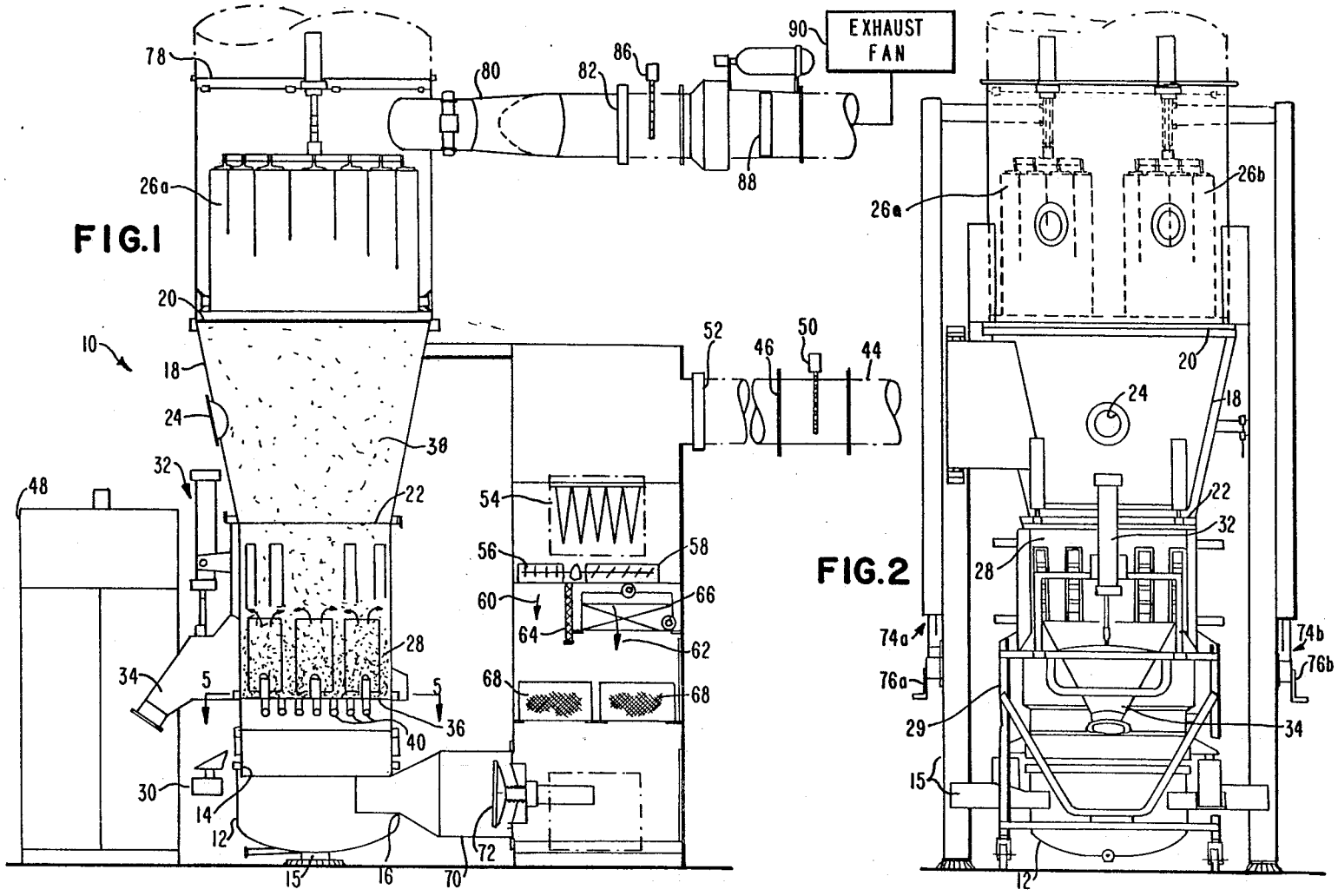
FIG. 1 is a schematic, cross-sectional view of a coating assembly according to the present invention.
FIG. 2 is a schematic, front elevational view of the coating assembly of FIG. 1.

Referring to the drawings in detail, and initially to FIGS. 1 and 2 thereof, a coating assembly 10 according to the present invention and of the type sold by Glatt Air Technique, Inc. of Ramsey, N.J. under Model Number GPCG 300/WURSTER 46" includes a bottom bowl 12 having an upper open end 14 and a side inlet opening 16 through which air is drawn. A hollow, frusto-conical transition section 18 is positioned in spaced relation above upper open end 14 of bottom bowl 12 and is coaxial therewith. As shown best in FIG. 2, bottom bowl 12 and transition section 18 are supported by a frame 15. Transition section 18 is open at its upper end 20 and its lower end 22. A site glass 24 is provided in transition section 18 for viewing by an operator. Further, two exhaust filters 26*a* and 26*b* are connected at the upper open end 20 of transition section 18 and are fluidly connected therewith for exhausting air therefrom.

A product container 28 is removably provided in the space between, and fluidly connects, bottom bowl 12 and frusto-conical transition section 18. Specifically, a transport trolley mechanism 29 pushes product container 28 toward the space between bottom bowl 12 and transition section 18, and in conjunction with a hydraulic lift 30, which is schematically shown, serves to lift and slide product container 28 into such space. In its operative postion, product container 28 sits inside of bottom bowl 12 and presses against an upper gasket seal (not shown) at lower end 22 of transition section 18. A lower gasket seal (not shown) is also provided between bottom bowl 12 and product container 28.

When the coating operation has been completed, transport trolley assembly 29 and hydraulic lift 30 remove product container 28 from such space. In this regard, product container 28 is also connected with a tilt cylinder assembly 32 having a pouring spout 34. Tilt cylinder assembly 32 functions to tilt only the bottom portion of porduct container 28 downwardly about a hinge (not shown), to thereby discharge the coated product therein through pouring spout 34 into a collecting drum (not shown). In the operative position of product container 28, the bottom portion of product container 28 is pivoted upwardly about the hinge to the position shown in FIG. 1 so that the lower screen is held against the bottom face or rim of product container 28.

Product container 28 is formed as a cylindrical container having a lower bed support screen 36 on which the product 38 to be coated is supported. When product container 28 is in its operative position, as shown in FIG. 1, air is drawn through side inlet opening 16, and up through bottom bowl 12, screen 36, product container 28, transition section 18 and exhaust filters 26*a* and 26*b*. As a result of such air flow, product 38 is maintained in a suspended state, as shown in FIG. 1.

Figure 5:
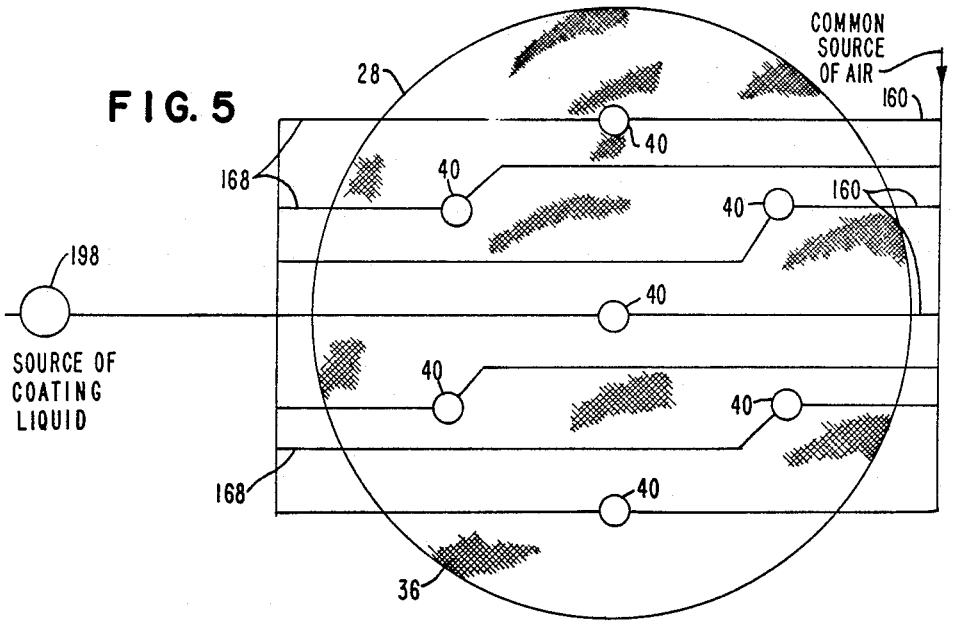
FIG. 5 is a schematic cross-sectional view of the coating assembly of FIG. 1, taken along line 5—5 thereof.

In addition, and particularly relevant to the present invention, a plurality of atomizing nozzles 40 are provided in product container 28, each extending upwardly through lower bed support screen 36. Preferably, there are seven such atomizing nozzles 40, arranged at the center and six corners of a regular hexagon, with each atomizing nozzle 40 being spaced equidistantly from each adjacent atomizing nozzle 40, as shown best in FIG. 5. Atomizing nozzles 40 are supplied with coating liquid through a distributor manifold (not shown) from a common source of coating liquid, as also shown in FIG. 5, and are also supplied with air from a common source of air. Accordingly, atomizing nozzles 40 direct fine droplets or atomized coating liquid upwardly into product container 28 and transition section 18 to coat the suspended product 38, which as aforesaid, may be potassium chloride crystals, with the coating liquid being a polymer coating liquid.

As shown in FIGS. 1 and 2, air is supplied to side inlet opening 16 as follows. Air enters an inlet duct 44, where the air flow thereof is measured by an orifice plate 46, which supplies an appropriate signal to an explosion proof pneumatic control cabinet 48. An inlet air temperature detector 50 is also provided in inlet duct 44, which detects the temperature of the air through inlet duct 44, and supplies an appropriate signal to control cabinet 48. The air then travels through a damper 52 which controls the amount of air flowing through inlet duct 44.

Specifically, control cabinet 48 supplies a control signal to damper 52 in response to the output signals from air flow detector 46.

The air then travels through a filter 54 and two control dampers 56 and 58. The output flow from control dampers 56 and 58 is separated into two streams 60 and 62, respectively, by a divider 64, as shown in FIG. 1. As shown, stream 62 flows through an inlet air heater 66. The amount of air flowing in each stream 60 and 62 is controlled by dampers 56 and 58, respectively, which in turn, are controlled by control cabinet 48. Streams 60 and 62 thereafter merge and travel through HEPA filters 68, which are fine pore filters that filter out micron size particles from the air flow. The filtered air from filters 68 travels through a connecting conduit 70 to side inlet opening 16 of bottom bowl 12. A quick action valve 72 is provided at the inlet of connecting conduit 70. Valve 72 serves to isolate bottom bowl 12 from the above-described inlet air assembly in the event of a fast rise in pressure due to an explosion. Specifically, in the event of an explosion, valve 72 is closed in a few milliseconds.

The outlet side of coating assembly 10, as aforesaid, is provided with two exhaust filters **26*a* and 26*b*. As a result, product 38 may become trapped in filters 26*a* and 26*b*. In this regard, filter lift winches 74*a* and 74*b* are provided, each secured to frame 15 and which support exhaust filters 26*a* and 26*b*, respectively, at the upper ends thereof, as best shown in FIG. 2. In this manner, by rotating handles 76*a* and 76*b* of winches 74*a* and 74*b*, respectively, filters 26*a* and 26*b* are shaken so that product 38 trapped therein falls back down into product container 28**.

Directly above filters **26*a* and 26*b* is a trap door 78 which opens to ambient atmosphere in case of an explosion inside coating assembly 10. However, in operation, the air through filters 26*a* and 26*b* travels through an outlet duct 80. A damper 82 is provided in outlet duct 80, and is substantially identical in relevant respects to damper 52. An outlet air temperature detector 86 is also provided in outlet duct 80, which detects the temperature of the air through outlet duct 80, and supplies an appropriate signal to control cabinet 48. Thus, the air travelling through damper 82 is controlled by a control signal from control cabinet 48 in response to the output signal from air flow detector 46**.

A quick action valve 88 is provided in outlet duct 80. As with valve 72, valve 88 serves to isolate product container 28 and transition section 18 from outlet duct 80 in the event of a fast rise in pressure due to an explosion. Specifically, in the event of an explosion, valve 88 is closed in a few milliseconds.

Finally, an exhaust fan 90 is connected to the end of outlet duct 80. Exhaust fan 90 serves to pull the air from inlet duct 44, through bottom bowl 12, product container 28, transition section 18 and outlet duct 80.

In operation, the crystal product 38 is suspended above screen 36, and atomizing nozzles 40 form a cloud of fine atomized droplets of the coating liquid in order to coat the crystals therewith. As the solvent contained in the coating solution evaporates into the hot air stream supplied through duct 16, bowl 12 and passing through screen 36 into product container 28, the polymer residue from the coating solution forms a barrier film around each crystal particle which later is instrumental to control the dissolution of the potassium chloride in the intestines. After a predetermined amount of time, during which the crystals of product 38 have been coated, atomizing nozzles 40 are rendered inoperative. The crystals are further dried in the warm air stream. The air flow is then terminated and the product thereafter is removed as an intermediate product. The dried, coated crystals are then compressed into tablet form.

Figure 6:
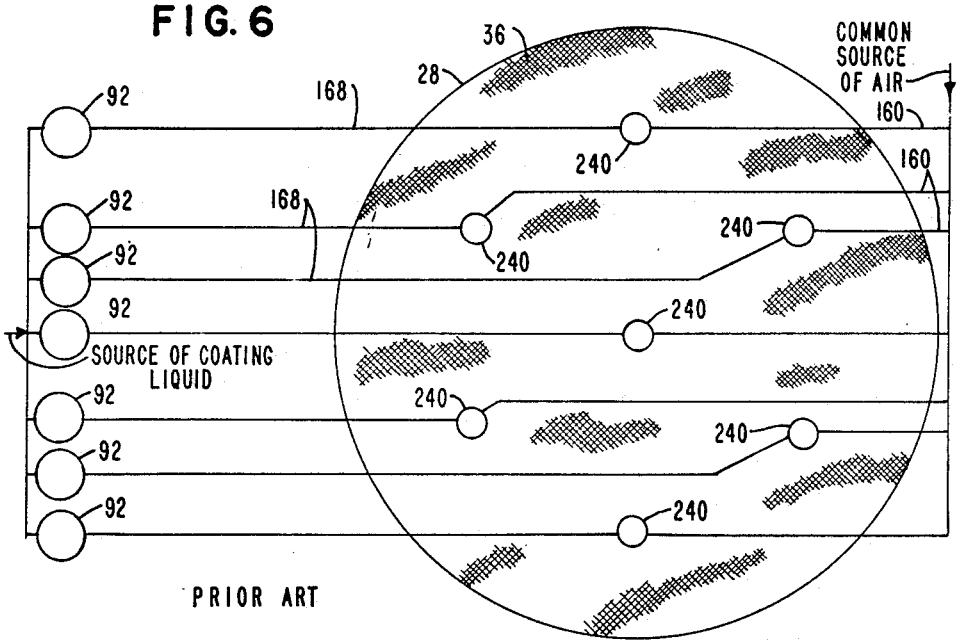
FIG. 6 is a schematic cross-sectional view of a prior art coating assembly, taken along the same view as FIG. 5.

As so far described above, Glatt coating assembly 10 is conventional. However, a problem with such coating assembly 10 is that it is necessary to provide the same flow of atomized droplets from each atomizing nozzle to ensure that the crystals are uniformly coated. Accordingly, it is necessary to regulate the flow of coating liquid to each nozzle. This is accomplished by providing a metering pump or flow meter 92 at the inlet to each prior art atomizing nozzle 240, as shown in FIG. 6. It will be appreciated that this is costly and requires frequent maintenance and recalibration to ensure coating uniformity.

Figure 3:
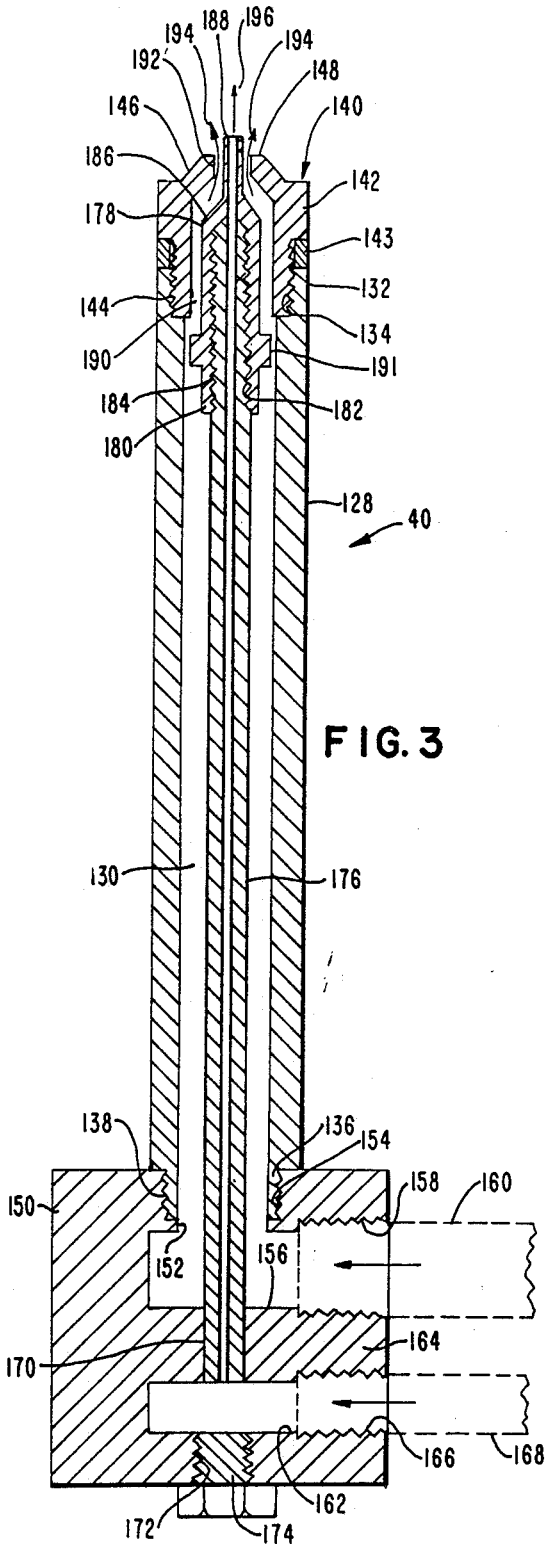
FIG. 3 is a longitudinal cross-sectional view of an atomizing nozzle according to one embodiment of the present invention for use with the coating assembly of FIG. 1.

Referring now to FIG. 3, an atomizing nozzle 40 according to the present invention for use with coating assembly 10 includes an elongated hollow air tube 128 defining a chamber 130 therein. Air tube 128 includes an atomizing end 132 having internal threads 134 and an opposite supply end 136 having external threads 138.

An air cap 140 has a cylindrical securing section 142 with external threads 144 that threadedly engage with internal threads 134 at atomizing end 132 of air tube 128. a spacer ring 143 is provided between atomizing end 132 of air tube 128 and securing section 142. Air cap 140 further includes a tapered frusto-conical section 146 integrally formed at the free end of securing section 142. The narrow free end of frusto-conical section 146 includes a central opening 148.

A supply housing 150 is provided at supply end 136 of air tube 128. Specifically, supply housing 150 is formed with a central axial bore 152 having internal threads 154 which threadedly receive external threads 138 at supply end 136 of air tube 128, so as to secure supply housing 150 to supply end 136 of air tube 128 with an airtight seal. Supply housing 150 further includes a transverse air supply port 156 in fluid communication with chamber 130 through central axial bore 152, air supply port 156 preferably including internal threads 158 for connecting an air supply line 160 thereto, as shown in dashed lines in FIG. 3.

Supply housing 150 further includes a transverse coating liquid supply port 162 separated from air supply port 156 by a separating wall 164. Coating liquid supply port 162 includes internal threads 166 for connecting a coating liquid supply line 168, as shown by dashed lines in FIG. 3. Separating wall 164 is provided with a through bore 170 which connects air supply port 156 with liquid supply port 162. As will be described in the discussion which folows, through bore 170 is effectively sealed to provide absolute separation between air supply port 156 and liquid supply port 162. Supply housing 150 further includes a cleaning bore 172 having internal threads for receiving a bolt 174 in a sealing manner. Bolt 174 can be removed for cleaning atomizing nozzle 40.

In accordance with an important aspect of the present invention, a flow control tube 176 is positioned in chamber 130 with one end thereof frictionally fit within bore 170 in a fluid sealing manner, that is, so as to fluidly isolate air supply port 156 from coating liquid supply port 162. The opposite end of flow control tube 176 extends to an axial postion adjacent atomizing end 132 of air tube 128. It will be appreciated that, in this manner, chamber 130 is defined as an annular space between air tube 128 and flow control tube 176. In this manner, coating liquid supplied from coating liquid supply line 168 flows through coating liquid supply port 162 into flow control tube 176, from which it is supplied to the atomizing end of atomizing nozzle 40.

A nozzle tip 178 is secured to the free end of flow control tube 176. Nozzle tip 178 includes a cylindrical securing section 180 having internal threads 182 which threadedly engage external threads 184 at the free end of flow control tube 176 to provide a fluid tight seal thereat. Nozzle tip 178 further includes a tapered frusto-conical section 186 integrally formed at the free end of securing section 180, and an atomizing tube section 188 of a lesser diameter than securing section 180 and integrally formed at the reduced diameter, free end of frusto-conical section 186. Atomizing tube section 188 extends through central opening 148 to a position slightly beyond frusto-conical section 146 of air cap 140. With this arrangement, it will be appreciated that a small annular gap 190 is provided between securing section 180 of nozzle tip 178 and securing section 142 of air cap 140 to permit passage of air therethrough from chamber 130. Preferably, annular gap 190 is provided with an outer circumferential restrictor 191 integrally formed thereon so as to provide a radial dimension of approximatly 0.005 inch between restrictor 191 and securing section 142. In a similar manner, the annular gap 192 between atomizing tube section 188 and the reduced diameter portion of frusto-conical section 146 preferably has a radial dimension of apaproximately 0.030 inch.

In basic operation, air flows to the atomizing end of atomizing nozzle 40 from air supply line 160, through air supply port 156, chamber 130, annular gap 190 and annular gap 192, as indicated by arrow 194. In a similar manner, the coating liquid is supplied to the atomizing end of nozzle 40 from coating liquid supply line 168, through liquid supply port 162, flow control tube 176 and atomizing tube section 188 of nozzle tip 178, as indicated by arrow 196. As a result of such air and liquid flow, the air tears the liquid stream into tiny droplets at the outlet or atomizing end of nozzle 40.

In accordance with the present invention, the air supply lines 160 of all atomizing nozzles 40 are connected to a common source of air, as in the prior art. In like manner, the coating liquid supply lines 168 of all atomizing nozzles 40 are connected to a common source of coating liquid. With the present invention, however, a single metering pump 198 is used to supply the liquid solution to atomizing nozzles 40 from the common source of coating liquid. In order to control the liquid flow through each atomizing nozzle 40, the inner bore of each flow control tube 176 is dimensioned to cause a pressure drop from 5 to 100 psi depending upon the flow rate from the common source of coating liquid and the viscosity of the coating liquid solution. In other words, the inner bores of flow control tubes 176 cause a flow constriction, resulting in a pressure drop, the extent of the flow constriction and pressure drop depending upon the inner bore size and length of low control tubes 176. It will be appreciated, however, that a constriction extending along a small length of low control tube 176 will not satisfactory perform according to the present invention. This is because the constriction must extend along a substantial length of flow control tube 176 to provide, for example, a pressure drop of 20–30 psi. Thus, for example, a reduced inner diameter along only one-fourth inch would be insufficient to produce the necessary pressure drop.

By matching the inner diameter and length of flow control tubes 176, each atomizing nozzle 40 will have the same pressure drop, and consequently, will pass the same amount of liquid if the nozzles are connected in parallel. It is therefore possible to split a feed stream into a plurality of equal streams with 1–2% accuracy over a wide range of flow rates. Further, if the same equipment is used to atomize fluids of different viscosities, several interchangeable sets of flow control tubes 176 having different lengths and inner diameter bore sizes can be used in order to obtain the same desired flow rate through each atomizing nozzle 40. It is also possible to achieve predetermined different flow rates through different atomizing nozzles 40.

In order to interchange flow control tubes 176, it is necessary only to remove air cap 140 and then remove nozzle tip 178 and flow control tube 176. Thereafter, nozzle tip 178 can be connected with a different flow control tube 176 and replaced in atomizing nozzle 40, along with air cap 140.

In a preferred embodiment of the present invention, and particularly, using the coating liquid sold by Schering-Plough Corporation under the trademark "K-DUR" in conjunction with a fluidized bed coater sold be Glatt Air Technique, Inc., the inner diameter bore size of each of the seven flow control tubes 176 was selected at 0.084 inch and the length of each flow control tube 176 was selected at eight inches. The viscosity of the coating liquid was approximately 100 centipoises and the total feed rate to the seven nozzles was varied in the range of 350 to 3500 cc/min. With such feed rate, it was determined that the pressure drop at 50 cc/min. per nozzle was 5 psi and the pressure drop at 500 cc/min. per nozzle was 50 psi.

It will therefore be appreciated that, with the present invention, there is no need to provide a metering pump or flow meter for each atomizing nozzle 40, as with atomizing nozzles 240 according to the prior art, as shown in FIG. 6. In addition, control of the flow through each atomizing nozzle 40 is readily accomplished by varying the internal bore size of flow control tubes 176.

Figure 4:
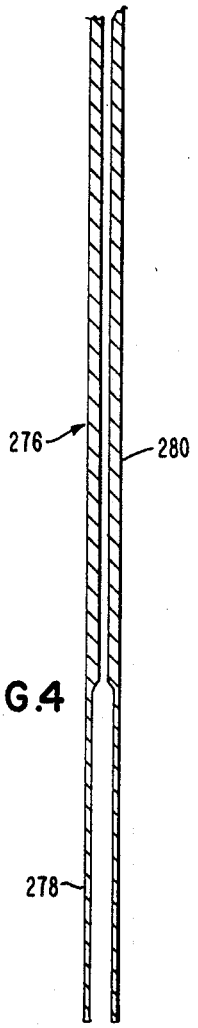
FIG. 4 is a longitudinal cross-sectional view of a flow control tube according to another embodiment of the present invention that can be used with the atomizing nozzle of FIG. 3.

Although flow control tube 176 has been shown in FIG. 3 as having a constant inner bore diameter throughout the entire length thereof, it will be appreciated that any suitable constriction can be provided within flow control tube 176. For example, as shown in FIG. 4, a flow control tube 276 according to another embodiment of the present invention includes a larger inner diameter section 278 at the inlet end thereof and a smaller inner diameter section 280 at the outlet end thereof. In such case, the length of the different sections along with their diameters must be taken into consideration to obtain the desired flow rate through flow control tube 276.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. An atomizing nozzle comprising:

(a) elongated hollow tube defining a chamber therein, said tube including opposite atomizing and supply ends, both in fluid communication with said chamber;

(b) a supply housing connected at the supply end of said tube, said supply housing including:

(i) an air supply port in fluid communication with said chamber, (ii) a liquid supply port in fluid communication with said chamber, said liquid supply port being separated from said air supply port; and (iii) a passageway interconnecting said air and liquid supply ports;

(c) flow constriction means for supplying said liquid from said liquid supply port to said atomizing end with a controlled flow constriction, said flow constriction means including flow control tube means, extending within said hollow tube between said liquid supply port and said atomizing end, for supplying said liquid to be atomized to said atomizing end, said flow control tube means having an inner bore providing said flow constriction to said liquid travelling from said liquid supply port to said atomizing end, said flow control tube means including a supply end and an atomizing end, said supply end removably extending within said passageway in a fluid sealing manner so as to fluidly separate said air supply port and said liquid supply port;

(d) an air cap removably secured to the atomizing end of said elongated hollow tube and having a central atomizing opening;

(e) said flow control tube means being dimensioned to permit removal and replacement of said flow control tube means through said atomizing end of said hollow tube when said air cap is removed therefrom; and (f) wherein said liquid is supplied from said flow control tube means through the atomizing end thereof, and air is supplied from said chamber through an annular gap defined between said flow control tube means and said air cap for atomizing the liquid exiting from said flow control tube means.

2. An atomizing nozzle according to claim 1; wherein said inner bore has a substantially constant reduced diameter through the entire length thereof.

3. An atomizing nozzle according to claim 1; wherein said inner bore has a reduced diameter only through a portion of the length thereof.

4. An atomizing nozzle according to claim 1; wherein said chamber is defined as an annular gap between said flow control tube means and said hollow tube for supplying air from said air supply port to said atomizing end.

5. An atomizing nozzle according to claim 1; further comprising a nozzle tip secured to the atomizing end of said flow control tube means and extending through said central opening, wherein said liquid is supplied from said flow control tube means through said nozzle tip, and air is supplied from said chamber through an annular gap defined between said nozzle tip and said air cap for atomizing the liquid exiting from said nozzle tip.

6. An atomizing nozzle assembly comprising:

(a) a plurality of atomizing nozzles, each atomizing nozzle including:

(i) an elongated hollow tube defining a chamber therein, said tube including opposite atomizing and supply ends, both in fluid communication with said chamber;

(ii) a supply housing connected at the supply end of said tube, said supply housing including:

(A) an air supply port in fluid communication with said chamber, (B) a liquid supply port in fluid communication with said chamber, said liquid supply port being separated from said air supply port; and (C) a passageway interconnecting said air and liquid supply ports;

(iii) flow constriction means for supplying said liquid from said liquid supply port to said atomizing end with a controlled flow constriction, said flow constriction means including flow control tube means, extending within said hollow tube between said liquid supply port and said atomizing end, for supplying said liquid to be atomized to said atomizing end, said flow control tube means having and inner bore providing said flow constriction to said liquid travelling from said liquid supply port to said atomizing end, said flow control tube means including a supply end and an atomizing end, said supply end removably extending within said passageway in a fluid sealing manner so as to fluidly separate said air supply port and said liquid supply port;

(iv) an air cap removably secured to the atomizing end of said elongated hollow tube and having a central atomizing opening;

(v) said flow control tube means being dimensioned to permit removal and replacement of said flow control tube means through said atomizing end of said hollow tube when said air cap is removed therefrom; and (vi) wherein said liquid is supplied from said flow control tube means through the atomizing end thereof, and air is supplied from said chamber through an annular gap defined between said flow control tube means and said air cap for atomizing the liquid exiting from said flow control tube means;

(b) air supply line means connected with each said air suppply port for supplying air to the chamber of each of said atomizing nozzles from a common source of air; and (c) liquid supply line means connected with each said liquid supply port for supplying said liquid to the flow constriction means of each of said atomizing nozzles from a common source of said liquid.

7. An atomizing nozzle according to claim 6; wherein each said inner bore has substantially constant reduced diameter through the entire length thereof.

8. An atomizing nozzle according to claim 6; wherein each said inner bore has a reduced diameter only through a portion of the length thereof.

9. An atomizing nozzle assembly according to claim 6; wherein each said chamber is defined as an annular gap between said flow control tube means and said hollow tube which supplies air from said supply port to said atomizing end.

10. An atomizing nozzle assembly according to claim 6; further comprising a nozzle tip secured to the atomizing end of each said flow control tube means and extending through said central opening, wherein said liquid is supplied from said flow control tube means through said nozzle tip, and air is supplied from said chamber through an annular gap defined between said nozzle tip and said air cap for atomizing the liquid exiting from said nozzle tip.

11. A coating assembly comprising:

(a) housing;

(b) screen means in said housing for supporting a material to be coated;

(c) a plurality of atomizing nozzles positioned to coat said material with a coating liquid, each atomizing nozzle including:

(i) an elongated hollow tube defining a chamber therein, said tube including opposite atomizing and supply ends, both in fluid communication with said chamber, the atomizing end of each said tube extending upwardly through said screen means;

(ii) an air supply port at said supply end in fluid communication with said chamber;

(iii) a coating liquid supply port at said supply end, said coating liquid supply port being separated from said air supply port; and (iv) flow constriction means for supplying said coating liquid from said coating liquid supply port to said atomizing end with a controlled flow constriction;

(v) an air cap removably secured to the atomizing end of said elongated hollow tube and having a central atomizing opening;

(vi) said flow constriction means being dimensioned to permit removal and replacement of said flow constriction means through said atomizing end of said hollow tube when said air cap is removed therefrom;

(d) air supply line means connected with each said air supply port for supplying air to the chamber of each of said atomizing nozzles from a common source of air;

(e) coating liquid supply line means connected with each said coating liquid supply port for supplying said coating liquid to the flow constriction means of each of said atomizing nozzles; and (f) single metering control means for controlling the flow of coating liquid from a coating liquid source to said coating liquid supply line means.

12. A coating assembly according to claim 11; wherein each said flow constriction means includes flow control tube means, extending within said hollow tube between said liquid supply port and said atomizing end, for supplying said liquid to be atomized to said atomizing end, each said flow control tube means having an inner bore providing said flow constriction to said liquid travelling from said liquid supply port to said atomizing end.

13. An atomizing nozzle according to claim 12; wherein each said inner bore has a substantially constant reduced diameter through the entire length thereof.

14. An atomizing nozzle according to claim 12; wherein each said inner bore has a reduced diameter only through a portion of the length thereof.

15. A coating assembly according to claim 12; wherein each said chamber is defined as an annular gap between said flow control tube means and said hollow tube which supplies air from said air supply port to said atomizing end.

16. A coating assembly according to claim 12; wherein each said flow control tube means includes an atomizing end; and further comprising a nozzle tip secured to the atomizing end of each said flow control tube means and extending through said central opening, wherein said liquid is supplied from said flow control tube means through said nozzle tip, and air is supplied from said chamber through an annular gap defined between said nozzle tip and said air cap for atomizing the liquid exiting from said nozzle tip.

17. A coating assembly according to claim 11; futher including a supply housing secured to the supply end of each said tube, each said supply housing including said liquid supply port and said air supply port.

18. A coating assembly according to claim 17; wherein each said supply housing further includes separating means for separating said air supply port and said liquid supply port, each said separating means including a bore therein; and each said flow constriction means includes flow control tube means extending within said hollow tube between said liquid supply port and said atomizing end, for supplying said liquid to be atomized to said atomizing end, each said flow control tube means having an end connected in said bore in a fluid tight manner to receive said liquid from said liquid supply port, each said flow control tube means having and inner bore providing said flow constriction to said liquid travelling from said liquid supply port to said atomizing end.

19. A coating assembly according to claim 11; further including upper filter means positioned in said housing above said first-mentioned screen means for preventing escape of said material from said housing 20. A coating assembly according to claim 11; further including means for forcing air through said screen means so as to suspend said material in an air stream above said screen means.

21. A coating assembly comprising:

(a) a housing;

(b) screen means in said housing for supporting a material to be coated;

(c) a plurality of atomizing nozzles positioned to coat said material with a coating liquid, each atomizing nozzle including;

(i) an elongated hollow tube defining a chamber therein, said tube including opposite atomizing and supply ends, both in fluid communication with said chamber, the atomizing end of each said tube extending upwardly through said screen means;

(ii) a supply housing connected at the supply end of said tube below said screen means, said supply housing including:

(A) an air supply port in fluid communication with said chamber, (B) a liquid supply port in fluid communication with said chamber, said liquid supply port being separated from said air supply port; and (C) a passageway interconnecting said air and liquid supply ports;

(iii) flow constriction means for supplying said liquid from said liquid supply port to said atomizing end with a controlled flow constriction, said flow constriction means including flow control tube means, extending within said hollow tube between said liquid supply port and said atomizing end, for supplying said liquid to be atomized to said atomizing end, said flow control tube means having an inner bore providing said flow constriction to said liquid travelling from said liquid supply port to said atomizing end, said flow control tube means including a supply end and an atomizing end, said supply end removably extending within said passageway in a fluid sealing manner so as to fluidly separate said air supply port and said liquid supply port;

(iv) an air cap removably secured to the atomizing end of said elongated hollow tube and having a central atomizing opening;

(v) said flow control tube means being dimensioned to permit removal and replacement of said flow control tube means through said atomizing end of said hollow tube when said air cap is removed therefrom; and (vi) wherein said liquid is supplied from said flow control tube means through the atomizing end thereof, and air is supplied from said chamber through an annular gap defined between said flow control tube means and said air cap for atomizing the liquid exiting from said flow control tube means;

(d) air supply line means connected with each said air supply port for supplying air to the chamber of each of said atomizing nozzles from a common source of air;

(e) coating liquid supply line means connected with each said coating liquid supply port for supplying said coating liquid to the flow constriction means of each of said atomizing nozzles; and (f) single metering control means for controlling the flow of coating liquid from a coating liquid source to said coating liquid supply line means.

* * * * *